United States Patent [19]

Srivastava et al.

[11] Patent Number: 4,629,937

[45] Date of Patent: Dec. 16, 1986

[54] COMPACT ELECTRON GUN FOR EMITTING HIGH CURRENT SHORT DURATION PULSES

[75] Inventors: Santosh K. Srivastava; Murtadha A. Khakoo, both of La Canada, Calif.

[73] Assignee: California Institute of Technology, Pasadena, Calif.

[21] Appl. No.: 576,148

[22] Filed: Feb. 2, 1984

[51] Int. Cl.[4] ..... H01J 23/16; H01J 29/96

[52] U.S. Cl. ..... 315/3; 328/58; 328/64; 328/229; 313/441

[58] Field of Search ..... 315/1, 3; 328/58, 64, 328/227, 228, 229; 313/441, 442

[56] References Cited

U.S. PATENT DOCUMENTS

| | | | |
|---|---|---|---|
| 2,462,860 | 3/1949 | Grieg | 328/58 |
| 2,982,917 | 5/1961 | Aaland et al. | 328/64 |
| 3,051,865 | 8/1962 | Marchese | 315/3 |
| 3,210,669 | 10/1965 | Allen, Jr. | 328/64 |
| 3,234,427 | 2/1966 | Orthuber | 328/64 |
| 3,374,387 | 3/1968 | Schmid | 315/3 |
| 3,402,357 | 9/1968 | Haimson et al. | 328/229 |
| 3,482,139 | 12/1969 | Leboutet et al. | 315/3 |
| 3,629,643 | 12/1971 | Roche | 328/229 |

*Primary Examiner*—Saxfield Chatmon
*Attorney, Agent, or Firm*—Jackson & Jones

[57] ABSTRACT

Disclosed is a pulsed electron beam gun for generating a high current, short duration pulse which is received by a pulse detection circuit. The gun has a gated electron beam emitting area, a beam deflection and sweeping area and a beam pulse detector. Magnetic collimating means having lines of force along an axis in the direction of the electron beam surrounds the aforementioned structure. The magnetic collimating means intensifies the density and strength of the electron beam once it is emitted from its source of emission and is gated through the electron gate. A conventional pulse source delivers a low voltage pulse and a delayed pulse. The internal impedance of the pulse source is matched at the location of the electron gun where the pulses are applied to the electron gun components. The first pulse, at the beam gate, causes a short burst of electrons to be emitted. The delayed pulse is applied to the deflection means to sweep the electron beam symmetrically across the electron passing aperture in the plate.

13 Claims, 4 Drawing Figures

COMPACT ELECTRON GUN FOR EMITTING HIGH CURRENT SHORT DURATION PULSES

BACKGROUND OF THE INVENTION

1. Field of the Invention

This invention relates to an extremely compact low voltage apparatus for generating high current subnanosecond duration electron pulses. More particularly, a short compact electron gun is described which has: (1) an electron emission area, (2) an electron beam gate which is either open or closed, (3) a beam deflection area which is maintained essentially free of space charge, (4) a small electron sweep aperture positioned at a relatively long distance away from the deflection area and located with the opening on an axis, and (5) a pulse detection circuit. The aforementioned structure is surrounded by a direct current magnetic collimating coil, which coil collimates the electron beam and thus increases its intensity and energy content.

Our invention employs a conventional low voltage pulse generator to deliver an electron gating pulse to the electron beam gate. That pulse has a magnitude which exists for a finite short time duration. A burst of electrons is gated "on" only during that finite duration. The energized magnetic coil accomplishes its collimation function and a tightly bunched electron beam of finite duration is thus formed. The electron beam is "off" in the absence of the electron beam gating pulse.

In our invention a bias condition is established such that when gated "on," the electron beam is normally held in an off-axis position. This off-axis bias condition results from a deflection potential which establishes an electric field between a pair of deflection plates in the deflection area. The direction and polarity of that field holds the beam in the off-axis position so that the beam cannot reach the beam detection circuit. A second pulse, time-delayed from the first, forms a beam deflection electric field in a direction opposite to the first field between the pair of deflection plates. That second field has sufficient polarity and strength to sweep the electron beam smoothly and quickly across the sweep aperture. This sweep, as is described in more detail in the specification, is termed a symmetrical sweep.

In accordance with our invention and the described operation a very high peak instantaneous current electron beam pulse is generated. In one preferred embodiment of our invention, that pulse is approximately 70 microamperes with an extremely short duration, or width, of approximately 0.35 nanoseconds.

2. Background Discussion

Electron pulses having high peak instantaneous current and subnanosecond duration are of great value in several diverse areas of the art. For example, such pulses are essential for measuring certain excited gas-phase species of interest. Some excited species, to give a typical example, may have lifetimes in the order of a few nanoseconds. Measurement of these lifetimes, within satisfactory error tolerance, requires that the electron beam pulses used to change the atomic states of the excited species under study must be as short as approximately 10% of the lifetime to be measured. If the state-changing electron pulse is too long, measurements of the decay rate of the atomic states will include a severe contribution from the shape of the electron pulse and consequently result in erroneous lifetime measurements.

Outer-space and similar environments pose severe weight and power limitations on the design of electron guns. Of course, pulsed beam electron guns are known in the prior art. Generally, however, such guns require kilovolt operational voltages and are available in lengths of several tens of centimeters. Obviously such guns, from a practical standpoint, have limited application when a compact, low power, relatively inexpensive electron gun is required.

Other applications in the art which require high amperage, short duration electron pulses include digital high definition television imaging systems which are under current investigation by the television industry. In many industrial applications such as visual displays, plasma switches, microcircuit etching, etc., a low cost electron gun is highly advantageous.

Conventional guns such as are described, for example, in U.S. Pat. No. 2,462,860 to D. D. Grieg exemplify the large-sized high-powered guns of the prior art. Implicit in such prior art is electrostatic focusing of the electron beam. Such electrostatic focusing inherently requires very large and lengthy deflection plates that represent a high capacitance in the system. Such high capacitance detracts from the ability to generate short duration pulses.

The prior art very often employs power supply voltages in the order of several kilovolts. The resulting structures of the prior art generally yield electron pulses with peak instantaneous currents of only a few microamperes while the pulse widths are normally in the order of several nanoseconds duration.

Attention is called to a U.S. Pat. No. 3,402,357 issued to J. Haimson, et al. which is directed to an apparatus for producing electron beam pulses having nanosecond or fractional durations thereof. See, for example, Col. 2, lines 40 through 48. Such structures are extremely complex and rely upon costly and cumbersome beam focusing lenses and a precisely controlled sequence of thyratron discharges in an effort to reduce the duration time of the electron beam pulse being generated. The complexity of this, and other similar prior art devices, severely limit their wide-spread applicability when a compact, low voltage electron gun is required.

SUMMARY OF THE INVENTION

Disclosed is a pulsed electron beam gun for generating a high current, short duration pulse which is received by a pulse detection circuit. The gun has a gated electron beam emitting area, a beam deflection and sweeping area and a beam pulse detector. Magnetic collimating means having lines of force along an axis in the direction of the electron beam surrounds the aforementioned structure. The magnetic collimating means intensifies the density and strength of the electron beam once it is emitted from its source of emission and is gated through the electron gate.

Positioned between the emitting means and the electron detector are pairs of electron deflection plates. One pair of plates is used to bias the beam so that it has a quiescent or steady state operation along the axis. The other pair of deflection plates are normally biased to deflect the collimated electron beam to an off-axis position. When deflected off-axis, the electron beam cannot reach the detector. An electron impervious plate is located along the axis and that plate is positioned between the deflection means and the detector. The plate has an electron passing aperture which is located in the on-axis position.

A conventional pulse source delivers a pulse and a delayed pulse. The internal impedance of the pulse source is matched at the location of the electron gun where the pulses are applied to the electron gun components. This matching utilizes the energy from the pulses to fullest advantage within the gun itself. The first pulse, at the beam gate, causes a short burst of electrons to be emitted. The delayed pulse is applied to the deflection means to sweep the electron beam symmetrically across the electron passing aperture in the plate. Conventional pulse sources with very low voltages are employed.

This invention avoids and eliminates any necessity to use magnetic focusing, and also avoids electrostatic focusing. Magnetic focusing is expensive, bulky and extremely complex. Electrostatic focusing detracts from the objective of achieving a high current, short duration pulse.

BRIEF SUMMARY OF THE DRAWINGS

FIGS. 2A through 2D, depicts cross-sectional views of pairs of cylindrical-shaped plates shown in the beam deflection area of FIG. 1.

DETAILED DESCRIPTION OF THE DRAWINGS

Figure 1:
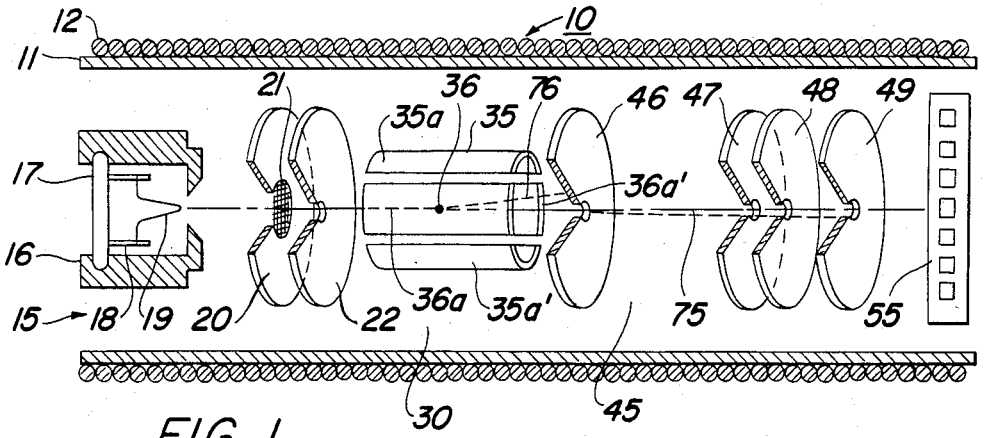
FIG. 1 is a combined schematic partly in cross-section and partly in perspective with cutaway sections showing the various portions of the electron beam gun of this invention.

FIG. 1 is a schematic view of the electron beam gun 10 of this invention. Gun 10 is cylindrical and is made of a suitable metal such as copper, which is shown in cross-section at 11. Surrounding the copper cylinder is the magnetic coil 12 used for collimating.

Gun 10 has structural elements which will be described in FIG. 1 from left to right. The first structural element is the beam emission area designated generally as 15. Within the beam emission area 15 is a cathode housing 16. The cathode housing surrounds a ceramic plate 17 on which a pair of posts 18 are mounted. Connected to the posts 18, which are electrically conductive, is a tungsten filament 19.

Numerous suitable electron emission systems are available and known to the prior art. The particular one described and depicted in FIG. 1 is the Pierce extraction system. That system utilizes a tungsten hairlike filament 19 which is approximately 0.13 mm diameter wire carrying 2.2 amperes of current. The cathode housing may be made of any suitable material known to the prior art such as molybdenum. The cathode housing is operated at approximately 0.7 electron volts with respect to the filament which is taken as a reference of 0 electron volts. The foremost part of cathode housing 16 is a cone-shaped beam gate. Under pulsing conditions this cathode housing is either gated "on" to let electron bursts out, or it is gated "off" to prevent electrons from leaving area 15.

To the right of the conical shape of cathode housing 16 is an anode plate 20. Anode plate 20 is a thin molybdenum plate about 0.5 mm thick with a 3 mm diameter aperture. Spot-welded across the aperture is a fine molybdenum grid 21 made of 0.05 mm diameter wire in a 0.5 mm square array. Only a portion of that grid 21 on plate 20 is shown in the drawing. Obviously, the anode is held in place within housing 11 by any conventional techniques such as, for example, stainless steel rings and mountings (not shown). The purpose of grid 21, which is electrically positioned at about 60 electron volts, is to extract the emitted electrons from filament 19 and pass them through a 1 mm diameter collimating aperture shown in the next adjacent plate 22. Once the collimated electrons have been passed through the aperture in plate 22, they enter the beam deflection area 30.

Positioned within the beam deflection area 30 are four separated cylindrical deflection plates. Each opposite deflection plate within the four form a deflection plate pair. Collectively the four deflection plates are numbered 35. To give an example of a pair, **35*a* is the upper plate, and 35*a'* is the other plate of that pair. In a similar manner, plates 36*a* and 36*a'*** form a second pair of deflection plates. As was true of the housing, the deflection plates may be made of copper. If so, the copper may be coated on the inside with colloidal graphite. This colloidal graphite, as well known in the art, reduces electron reflections.

We have found that electron reflections are a major hindrance in attempting to gain high amperage, short duration pulses of the type generated by this invention. The operation of the deflection plate pairs will be more fully described under the heading "Operation." Briefly, however, the deflection plate pairs either leave the collimated electron beam in an on-axis position 75, or steer the collimated electron beam in an off-axis position 76. Of particular importance in the operation are the biases and the pulsing of these deflection plates. This operation also is described subsequently.

In the preferred embodiment of this invention, the length of each deflecting plate is 1.2 cm and its curvilinear width is 0.5 cm. The deflector plates are placed 0.8 cm apart. They steer the electron beam through additional molybdenum plates having limiting apertures which are located in the beam passing aperture area marked on the drawing collectively as area 45. The first aperture plate 46 in area 45 is located adjacent the exit of the beam deflection plates. Digressing a moment, it should be noted that the center point of the beam deflection plates is depicted at 36. That center point of the deflection plates marks a measuring point. Aperture plate 46, in our preferred embodiment, is located 1.5 cm away from the center 36 of the deflection plates. The second limiting aperture in area 45, namely the aperture in plate 47, is located 2.5 cm away from the center 36 of the deflection plates. Two additional 1 mm apertures are located in plates 48 and 49 just prior to the detector 55. These distances and various other dimensions are discussed in more detail later on in the description of our invention. They represent significant factors for an equation, developed in accordance with this invention, which defines the dependence of the electron pulse width on various parameters within the electron gun.

When the highly collimated electron beam is on-axis it passes through all of the aforementioned apertures and reaches the electron pulse detector 55. FIG. 1 also depicts an alternate situation, as shown by the dashed lines 76 wherein the electron beam as it leaves the center of the deflection plates moves off-axis and strikes the impervious surface of plate 46. When the electron beam strikes plate 46, the electrons do not reach detector 55.

Having completed the description of the structural components of the electron gun of this invention, we will now describe the operation of the electron gun. In order to promote ease of understanding, we will first describe our electron gun with a steady state operation, that is, with the electron beam not subject to any pulsing. This steady state operation does not create pulses without further additional operation. The pulsing operation will then be described in order to more clearly demonstrate why, with the low voltages and very compact operation of this electron gun, high amperage, short duration electron pulses are generated.

STEADY STATE OPERATION

Our electron gun invention provides a steady state operation in accordance with the structure shown in FIG. 1, wherein certain voltages will be assumed as present on various ones of the components of the gun. For example, it has already been described that the filament bias is taken as a zero reference point. That filament bias is subject to sufficient voltage to create a couple of amperes of current through the filament so that electrons are emitted from the tungsten wire 19, FIG. 1.

A conventional source of direct current (not shown) supplies electrical current to the magnetic collimating coil 12. This coil has a few thousand turns of wire mounted on the copper cylinder 11. That copper cylinder, in our preferred embodiment, has an outside diameter of 3.0 cm and a length of 7.0 cm. A current of approximately 0.2 to 0.3 amps will create a magnetic field in the order of 100 to 150 Gauss. The magnetic field lines of force are parallel to the axis 75. These lines of force serve to collimate the electron beam in a manner which is well known in the art. Furthermore, we discovered that these coils also bake the electron gun to approximately 120° centigrade when in use.

Cathode 16, FIG. 1, is assumed to be gated "on" for purposes of this description. The anode 20 is operated at 60 electron volts. That 60 electron volts, although relatively low, is sufficiently high to pull emitted electrons from the filament out of the cone-shaped housing of cathode 16 and pass them down axis 75.

A highly collimated electron beam is achieved by the magnetic collimation coils. That beam, as is well recognized in the art, has its own voltage. Typically the voltage of an electron beam is measured at the centerline of the beam itself. To give a typical example, the electron beam will have at its centermost point approximately 5 electron volts. The diameter of the electron beam is, in our preferred embodiment, collimated to approximately 1 mm in diameter. Assuming that size electron beam, the center point of the beam would have 5 electron volts in the deflection region.

As shown in FIG. 2A, both plate pairs may have their bias voltages varied slightly. The slight variations finely balance the electron beam so that it is located precisely on-axis 75. If one pictured themselves in the precise center of the electron beam at 5 electron volts looking at each of the deflection plates of the two pairs, one would see 5 electron volts at each one of the plates. In accordance with these conditions, the collimated electron beam passes along axis 75 and ultimately reaches detector 55.

It requires only a small variation in voltage to move the electron beam off-axis. For example, as shown in FIG. 2B, if plates 35*a* and 35*a'* are located at approximately 5.2 volts for plate 35*a* and 4.8 volts for plate 35*a'*, then the electron beam will move upwardly, FIG. 1, towards the 5.2 volts of plate 35*a* on the curved path depicted in dashed lines 76. In this off-axis location the beam strikes the electron impervious area of plate 46.

PULSED OPERATION

A sequence of beam deflection voltages is normally applied to one pair of the beam deflection plates. At the other deflection plate pair, a steady state voltage on the opposing pairs which are spaced 1 cm apart would be as shown in FIG. 2A with 5 electron volts on the top and 5 electron volts on the bottom. When the electron gun is getting ready for a sweep condition, 10 electron volts, as shown in FIG. 2C, is on the top deflection plate and 0 electron volts is present on the bottom deflection plate. This causes the 5 electron volt beam to be off-axis in the upper part of the plate, as is shown in cross-section in FIG. 2C. As depicted in FIG. 2C, the conventional positive electric field is shown by the arrows which are going from 0 volts to 10 volts. Electrons are deflected in the direction opposite to that of the electric field since they are negatively charged.

In accordance with the principles of this invention, the delayed pulse which is applied to the lower deflection plate which is at a 0 volt condition will have a maximum magnitude of 20 volts. Exactly at the point when the 20-volt pulse has reached half of its amplitude, there will then be 10 volts on the upper plate and 10 volts on the lower plate, and the electron beam will be on-axis. As the pulse continues on to an upper amplitude of its peak 20-volt amplitude, the beam moves down into an area adjacent the lower plate, as is shown in FIG. 2D.

Once pulse 302 reaches its maximum amplitude and returns to 0 volts, the beam (if it were present) would move back to its upward position as shown by FIG. 2C. Since the voltage condition for the upward movement does not occur until after the beam gate has been turned "off," no further pulse is generated.

Figure 2E:
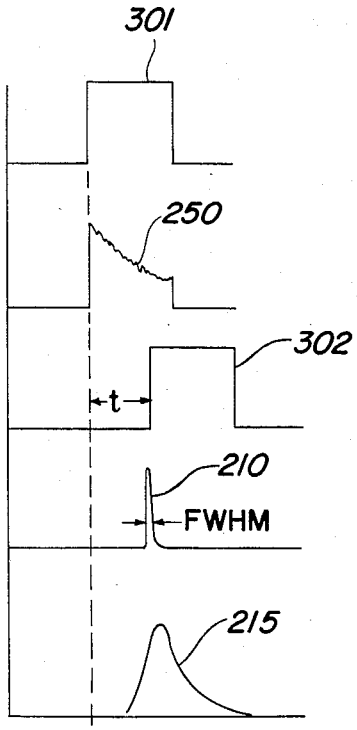
FIG. 2E shows pulses that are used in the operation of the electron gun.

In order to accomplish the very high amperage, narrow width duration electron beam pulse in accordance with this invention, additional steps are required other than the pulsing sequence for the beam deflection plates. The pulse waveforms of FIG. 2E depict these additional steps. The sequence of steps are depicted by the pulse waveforms of FIG. 2E as shown from the top to the bottom in that figure. The top row depicts a 20 volt essentially vertical leading edge pulse 301 which is a voltage pulse that is applied to the beam gate, or cathode housing 16, of FIG. 1. The second row from the top in FIG. 2 depicts the electron burst 250 when the beam gate 16 is subjected to the beam gate pulse 301.

Figure 2:
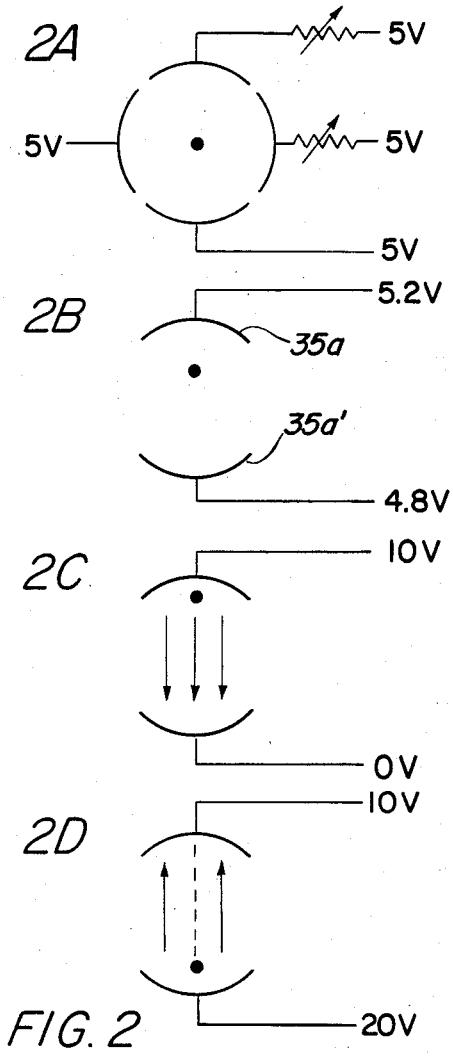
FIG. 2, includes

In row 3 of FIG. 2 after a suitable delay time, -t-, a delayed pulse 302, also 20 volts in amplitude and having an essentially vertical leading edge, is applied to the bottom plate of the deflector plate pair as described with respect to FIG. 2D. By applying this delayed pulse to the most negative potential with respect to the plate pair, a symmetrical sweep of the electron beam downwardly and across the aperture opening is accomplished. When that sweep occurs, as is depicted in row 4 of FIG. 2E, there is a very high amperage, extremely narrow duration, transmitted electron pulse 210 which goes through the double limiting sweep apertures described in connection with FIG. 1.

Comparison of the time of occurrence of the trailing edges of pulses 301 and 302 shows that the beam gate is "off" when 302 falls to 0 volts. Pulse 302 falls to 0 volts at a later time and thus the voltage conditions needed for the next pulsing operation are restored. That restoration occurs without any further electron beam pulse being emitted.

Figure 3:
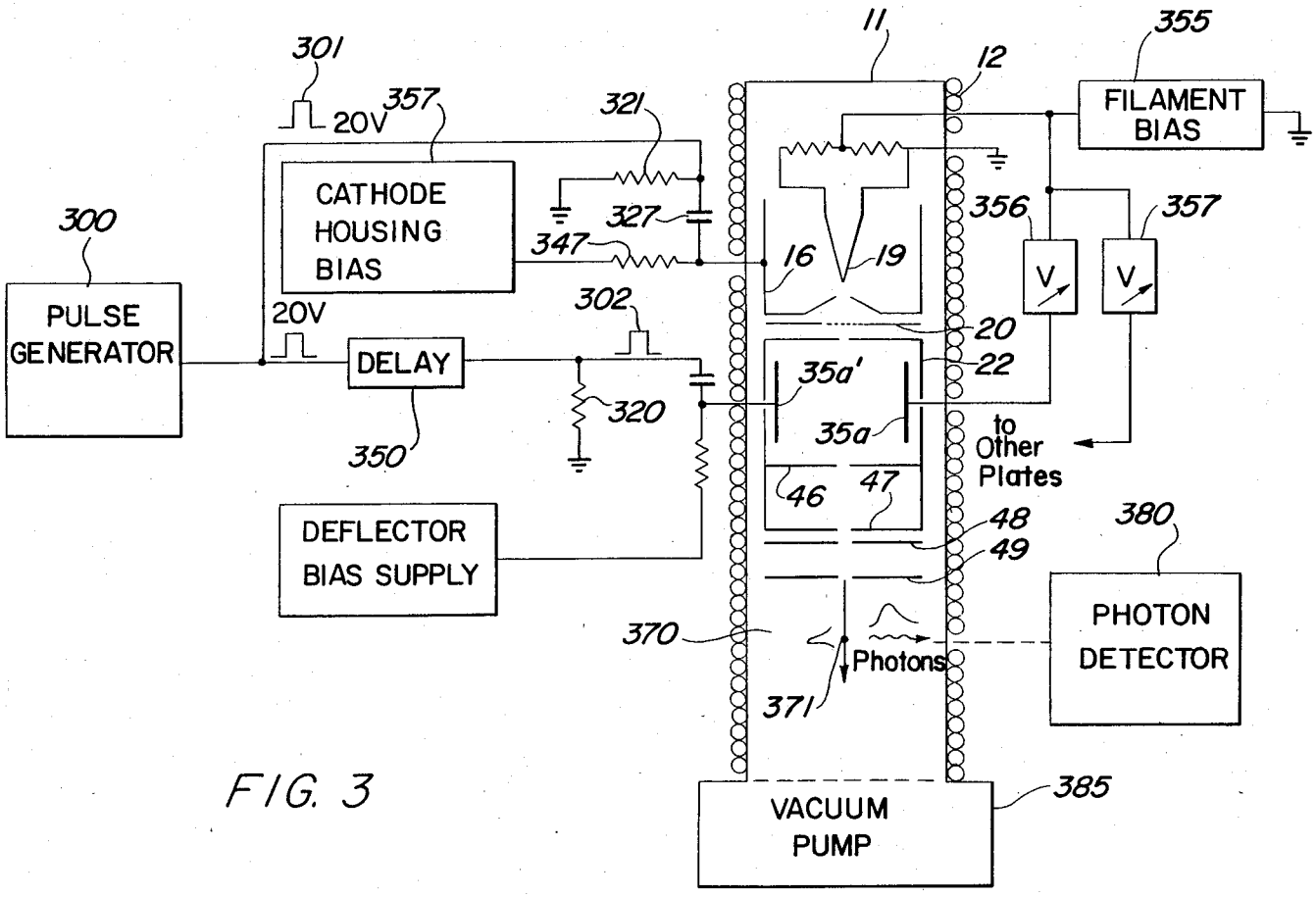
FIG. 3 is a circiut depicting the use of conventional pulse sources with the various connections as required by this invention.

FIG. 3 repeats in schematic form the electron gun of this invention. Also shown in FIG. 3 is the pulse generator 300 which generates the beam gate pulse 301 and the delayed pulse 302 which is used to deflect the beam into the apertures. The pulse generator 300 is a conventional 40-volt output pulse generator. The 40-volt output is divided into 20-volt pulses 301 and 302, as shown in FIG. 3.

Filament bias supply 355 and plate bias voltage sources 356 and 357 have already been described earlier. Briefly, the filament bias 355 creates sufficient current flow to cause electron emission by filament 19. Plate bias sources 356 and 357 have been adjusted to assure on- and off-axis position of the electron beam in accordance with the desired operational state at issue.

Pulse generator 300 is any conventional pulse source known in the art. Pulse generator 300 may have, as an example, an output impedance of 50 ohms. In order to avoid any kind of delays or circulating currents within the cathode housing bias or the deflector plate bias supply circuits, a 50-ohm terminating impedance 321 and 320, respectively, is present in each of these circuits. Thus the impedance of the pulse generator is properly matched to the terminating impedance of both pulse application circuits.

In the cathode housing pulsing circuit, a capacitance 327 is connected in circuit with the 50-ohm resistor 321. Capacitor 327, for example, may be 1.2 picofarads. This capacitance is also connected to a high resistance 347 of 1.1 kilohms.

Cathode housing bias supply 357 is set at 10 volts with respect to ground to give a typical example as used earlier in the specification. As pulse 301 is selectively emitted under control of an operator as, by example, through the operation of a switch (not shown), that pulse 301 is immediately diverted into the cathode housing, or beam gate area, by the virtue of the high impedance of resistor 347 and capacitor 327. The full 20-volt potential of that pulse is applied to the cathode housing 16 to cause a burst of electrons to be pulled through the conical aperture area of housing 16 as earlier described. Subsequent to that pulse, as shown by the use of a delay circuit 350, the delayed pulse 302 is applied in a similar manner to the deflection plate pair of plates 35*a* and 35*a'*. The beam will then be moved on-axis.

In the particular instance wherein our invention was employed, we found it necessary to verify the narrowness of our pulse by the use of devices and techniques other than any conventional measuring instruments. We used a standard species to determine the accuracy of the narrowness of the pulses generated by the electron beam gun of this invention.

In the art, it is well known that a target gas beam of helium atoms can be studied as a target source. A hypodermic needle of an inside diameter of 0.3 mm and length 3.5 cm emitted the gas source 371 into the plane of paper, as shown in FIG. 3. This gas source was operated at various pressures ranging from 0.1 Torr to 0.01 Torr, the whole system being enclosed in a vacuum chamber pumped by any conventional vacuum pump 385 to achieve the required environment for the operation of the electron gun. Source 385 produced a target gas pressure in the region 370 of approximately $10^{-4}$ to $10^{-5}$ Torr. Under these operating conditions the experimental vacuum tank pressure rose from $10^{-8}$ Torr to $10^{-10}$ Torr as measured by any standard ionization gauge (not shown).

As is well known in the art, a photon detector 380 was used to detect 584 Angstrom helium radiation. In our case, detector 380 has a Bendix Bell-Ended Spiral Electron Multiplier Type 4219 which viewed the collision region between the electron gun pulse 210, FIG. 2E, and the target gas beam 371, FIG. 3. The photon detector was positioned with a field of view at a right angle with respect to both the electron pulse 210 and the gas target beam 371. Detector 380, once a signal was detected, was subjected to a typical and well known curved fitting technique.

The method of data acquisition and the curve fitting techniques used are well known and are beyond the scope of this invention. These techniques need not be described in detail here. What is important is to recognize that the lifetime of the $2^1P \rightarrow 1^1S$ transition in helium is extremely short and has been precisely determined.

This property of the change in state of helium was used to verify the merits of our invention. For example, the detected photon signal results in a decay curve approximately shaped as shown at 215 in FIG. 2E. The photon signal is detected (conventionally) in delayed coincidence with the electron pulses. By using curve fitting techniques, the width of the electron pulses can be extracted from the photon signal.

The photon detector 380 shown in FIG. 3 accomplished the study of the time spectra of the rate of decay of the $2^1P$ excited state of helium at a fluorescence of 584 Angstron photons. The values that were obtained were recorded for 5 electron volts, 7.5 electron volts and 10 electron volts of electron beam energies as measured in the deflection region 35, FIG. 1. Spectra were repeated several times to ensure the data reproducability.

Table 1 lists the various results of our experiments using the invention and measuring the helium 584 Angstrom photon as a target beam.

TABLE 1

| Tank Pressure Torr ($\times 10^{-7}$) | No. of Points Used in Fit | Chi Squared Value | Lifetime Value (nS) | Error (nS) | $e^-$ Pulse Width (nS) (FWHM) | Error (nS) | Deflector Region Energy (eV) | Peak Pulsed Current (μA) |
|---|---|---|---|---|---|---|---|---|
| 6.0 | 60 | 7.0 | 0.940 | ±0.266 | 0.312 | ±0.064 | 5 eV | 80 |
| 6.0 | 60 | 6.18 | 0.992 | ±0.213 | 0.360 | ±0.068 | 10 eV | 72 |
| 6.0 | 80 | 4.34 | 1.160 | ±0.354 | 0.420 | ±0.080 | 15 eV | 54 |
| 4.6 | 60 | 2.55 | 0.981 | ±0.322 | 0.332 | ±0.084 | 5 eV | 62 |
| 4.6 | 60 | 4.86 | 0.957 | ±0.228 | 0.340 | ±0.105 | 5 eV | 62 |
| 4.0 | 60 | 6.46 | 0.889 | ±0.195 | 0.330 | ±0.072 | 5 eV | 62 |
| 3.1 | 60 | 4.98 | 0.735 | ±0.191 | 0.335 | ±0.064 | 5 eV | 70 |
| 2.4 | 60 | 5.92 | 0.792 | ±0.184 | 0.320 | ±0.073 | 5 eV | 78 |
| 1.25 | 60 | 6.48 | 0.748 | ±0.160 | 0.315 | ±0.067 | 5 eV | 78 |
| 1.0 | 60 | 6.35 | 0.665 | ±0.167 | 0.320 | ±0.071 | 5 eV | 62 |

TABLE 1-continued

| Tank Pressure Torr ($\times 10^{-7}$) | No. of Points Used in Fit | Chi Squared Value | Lifetime Value (nS) | Error (nS) | $e^-$ Pulse Width (nS) (FWHM) | Error (nS) | Deflector Region Energy (eV) | Peak Pulsed Current ($\mu$A) |
|---|---|---|---|---|---|---|---|---|
| 0.8 | 60 | 7.82 | 0.508 | ±0.121 | 0.340 | ±0.068 | 5 eV | 62 |

Each of the columns of Table 1 have listed, at the top of the vertical columns, the data we measured. The tank pressure (measured at $10^{-7}$ Torr) is self-explanatory. The number of points used in the curve fitting process is supplied in the second vertical column of Table 1. The curve fitting technique used to arrive at the narrowness of the pulse involves a chi$^2$ value. Those values for this curve fitting technique are supplied in the third vertical column of Table 1.

The lifetime value in nanoseconds is that of the states given above for the decay time of helium once it has been excited and then is dying away. The next column in Table 1 sets forth the plus or minus error in nanoseconds which were obtained from our curve fitting technique by comparing the electron pulse shape to the decay time of the helium target gas. The next column in Table 1 is the pulse width in nanoseconds at the Full Width Half Maximum (FWHM) of pulse 210, FIG. 3E. The Full Width Half Maximum of the pulse as emitted by this invention is a standard measuring point and is shown by double arrows located on waveform 210.

The next column in Table 1 is the error again in nanoseconds as predicted by the measurement technique used. The next two columns are self-explanatory. Defined in those two columns are the deflection region energy in electron volts and the peak pulsed current in microamps for the various electron volts involved. As is shown by the bottom horizontal row, at a tank pressure of $0.8\times10^{-7}$ Torr at 5 electron volts energy for a 5-electron volt beam, the peak current was 62 microamps and the electron pulse width at the full width half maximum location was 0.340 nanoseconds. Obviously, within the 5-electron volt region, our invention provided very narrow electron pulses ranging from 0.312 to 0.340 nanoseconds. The peak pulse current in microamperes for that respective range was between 62 and 78 microamperes. The results of Table 1 prove that this electron beam gun invention provides a very narrow electron pulse width with high current values.

At this point it is deemed worthy to summarize some of the significant aspects of this invention. In order to summarize those advantages, we have set forth formula (1) which is applicable in our invention for achieving the highly beneficial pulse 210, FIG. 2E.

The electron beam pulse width is expressed as:

$$W = \frac{2 \cdot V_o \cdot d \cdot \tau_o \cdot \sqrt{a^2 + \delta^2}}{L \cdot 1 \cdot V_1} \quad (1)$$

where $V_o$ is the energy (eV) of the electrons in the deflection region, d is the separation (cm) between the deflection plates, $\tau_o$(ns) is the rise time of the applied deflector pulse, a (cm) is the electron beam diameter, $\delta$ (cm) is the diameter of the most remote limiting aperture from the deflector plates, L (cm) is the distance of this limiting aperture from the center 36 of the deflector plates, 1 (cm) is the length of the deflector plates and $V_1$ (Volts) is the amplitude of the applied pulse to the deflector plates. For the experimental values of the parameters given previously, the theoretical value of W obtained from Equation 4 is approximately 250 pS, for 5 eV energy electrons in the deflection region, and a 1 mm electron beam.

Allowance, of course, must be made for stray capacitance, time-of-flight, electron pulse broadening and possible defocusing of the electron beam. These allowances cause our theoretical pulsewidth to increase slightly as we have experimentally observed.

When one analyzes our formula, it is clear that certain factors are paramount in importance. Thus:

1. The distance from the center of the plates to the sweep apertures, namely L, is better when that number is larger.
2. The size of the sweep aperture, $\delta$, is better when it is kept very small.
3. The size of the electron beam, a, is better when it is also kept very small. It should be noted at this point that Items 2 and 3 cannot be treated separately. In other words, the size of the aperture and the size of the electron beam are closely interrelated and must match one another.
4. The rise time of the voltage pulse applied both to the beam gate and to the deflector plates is important. A sharper rise time yields a narrower output pulse.
5. The energy of the electron beam at the deflection region should always be kept to a small amount. By that we mean that the forward velocity of the electron beam being swept across the aperture is better if the velocity is slower.

As the length of the deflection plates increases, the capacitance of the plates will increase. As we noted hereinbefore, it is not desirable to have high capacitance in the plates because higher capacitance causes wider output pulses. Simply as a point of reference, in the electron beam gun of a preferred embodiment of our invention, the capacitance of the deflector plates was estimated to be approximately 30 picofarads. That value is low enough to enable fast pulsing of one of the deflector plates. Because of the low value of the capacitance of the deflector plates, our invention achieved the unexpected and unusual results of a very high amperage, narrow duration electron beam pulse.

The background level of the electron gun pulses was very low. For example, on average the signal-to-background ratio was 500:1. This demonstrates the advantage of our double pulsing system over conventional sweeping methods in that the presence of unwanted electrons around the limiting apertures can be suppressed when the electron beam is in the off-axis position.

Further, the compactness of the electron gun is a desirable property. This double pulsed gun is approximately 10 cms long, much shorter than prior art pulsed electron systems which employ magnetic lenses or electrostatic focusing techniques. The widths or our electron beam pulses are well below 1 nS and are adequate to enable us to make the measurements of gaseous species lifetimes. If shorter pulsewidths are needed, the length of the deflection region could be increased at the expense of compactness.

The above description presents the best mode contemplated in carrying out the present invention. This invention is, however, susceptible to modifications and alternate constructions from the embodiments shown in the drawings and described above. Consequently, it is not the intention to limit the invention to the particular embodiments disclosed. On the contrary, the invention is to cover all modifications, sizes and alternate constructions falling within the spirit and scope of the invention as expressed in the appended claims.

What is claimed is:

1. A portable, compact low voltage electron gun for emitting a high current subnanosecond duration pulse, said gun including an electron emitting area at one end of said gun on a longitudinal beam axis, an electron collecting area at the other end of said gun and also located on said longitudinal beam axis, a beam deflecting area on said beam axis and located between the emitting and collecting areas, said gun comprising:

said electron beam deflecting area having low capacity beam deflection plates and a beam barrier positioned between the beam deflection plates and adjacent to the electron collecting area, said barrier having an electron passing sweep aperture on said longitudinal electron beam axis for the gun;

means at said electron emitting area responsive to application of a finite duration voltage for emitting a highly concentrated bunch of electrons in a low electron voltage beam;

first means including a low voltage source connected to said beam deflection plates for biasing said electron bunch into said electron beam barrier;

a source of direct current;

an electromagnetic field creating and electron beam collimating means connected to said direct current source with said electromagnetic means being continuous and substantially surrounding the entire length of said gun, including said beam emitting, deflecting and collecting areas for constricting said emitted electron bunch into a highly collimated low electron voltage beam along said beam axis and throughout said entire length of said gun;

second means including said low voltage source connected to said beam deflection plates operative during said finite duration and responsive essentially to a low valued step voltage for sweeping said electron bunch across said sweep aperture; and an output circuit for emitting a full width half maximum pulse, W (ns) expressed as:

$$W = \frac{2 \cdot V_o \cdot d \cdot \tau_o \sqrt{a^2 + \delta^2}}{L \cdot l \cdot V_1}$$

wherein $V_0$ is the energy (eV) of the collimated and constricted electrons in the deflection area, d (cm) is the separation distance between said deflection plates, $\tau_o$ (nS) is the rise time of said step voltage, a (cm) is the widest dimension of the collimated and constricted beam bunch, $\delta$ (cm) is the widest dimension of the sweep aperture, L (cm) is the distance of the sweep aperture from the center of the deflector plates, 1 (cm) is the length of the deflector plates along said longitudinal beam axis, and $V_1$ (volts) is the step amplitude of the low valued step voltage.

2. An electron gun in accordance with claim 1 wherein the electron barrier comprises:

a plurality of electron impervious plates each having a sweep aperture on said longitudinal axis and wherein $\delta$ is located in the plate furthest away from the center of said deflection plates.

3. An electron gun in accordance with claim 1 in combination with a low voltage source means for emitting low voltage pulses, said combination comprising;

an electron beam gate in said electron emitting area; and means for applying a low voltage first pulse of finite duration from said low voltage source means to said electron beam gate.

4. An electron gun combination in accordance with claim 3 and further comprising:

means for applying a second low voltage pulse from said low voltage source, said second pulse characterized by essentially a vertical rise time of $t_0$ and a maximum amplitude of $V_1$ volts; and wherein said second means includes means applying said second low voltage pulse to said beam deflection plates for sweeping said collimated electron bunch across said sweep aperture.

5. An electron gun combination in accordance with claim 4 and further comprising:

an internal impedance for said pulse source means; and means terminating each of said first and second pulse applying means in an impedance which matches said internal impedance.

6. An electron gun in accordance with claim 1 wherein said first means at said beam deflection plates includes:

a first source of deflection potential for establishing an electric field of one polarity between said deflection plates.

7. An electron gun in accordance with claim 6 and wherein said second means at said beam deflection plates includes:

a second source of deflection potential for establishing an electric field of opposite polarity between said deflection plates.

8. An electron gun in accordance with claim 1 wherein said beam deflection plates comprises:

a first pair of opposing cylindrical deflection plates connected to said first biasing means; and a second pair of opposing cylindrical deflection plates connected to said second means.

9. An electron gun in accordance with claim 1 wherein said gun has a cylindrical housing, and further comprising:

an electromagnetic coil of cylindrical shape surrounding the cylindrical housing of said electron gun.

10. An electron gun in accordance with claim 9 wherein said beam deflection plates comprises:

a first and a second pair of opposing thin-walled cylindrical deflection plates.

11. An electron gun in accordance with claim 10 wherein said housing and said first and second pair of deflection plates further comprises:

colloidal graphite coating means for minimizing electron reflections.

12. An electron gun in accordance with claim 10 wherein:

said magnetic field constricts said electron burst to a circular cross-section having a diameter essentially the same as the widest dimension of the sweep aperture; and said sweep aperture is a circular opening in said beam barrier.

13. An electron gun in accordance with claim 4 wherein:

the detection potential is reached during the midpoint instant in the leading edge of said second pulse; and the trailing edge of said first pulse has passed before the trailing edge of the second pulse appears so that the beam deflection potential is returned to an off-axis condition when said electron emitting area is gated off.

* * * * *